US005149499A

United States Patent [19]

Kim et al.

[11] Patent Number: 5,149,499

[45] Date of Patent: Sep. 22, 1992

[54] COOPER-FE-P-NB ALLOYS FOR ELECTRICAL AND ELECTRONIC PARTS AND ITS MANUFACTURING PROCESS

[75] Inventors: Young G. Kim; Han I. Yoo, both of Seoul; Sang K. Han, Ulsan; Deung Y. Lee, Seoul, all of Rep. of Korea

[73] Assignee: Poongsam Corporation, Seoul, Rep. of Korea

[21] Appl. No.: 756,171

[22] Filed: Sep. 6, 1991

[30] Foreign Application Priority Data

Sep. 18, 1990 [KR] Rep. of Korea ..... 14754/1990

[51] Int. Cl.[5] ..... C22C 9/00

[52] U.S. Cl. ..... 420/495; 420/496; 148/411; 148/681; 148/682

[58] Field of Search ..... 420/495, 496, 499; 148/411, 432, 681, 682

[56] References Cited

FOREIGN PATENT DOCUMENTS 62-112763 5/1987 Japan ..... 148/681
63-310929 12/1988 Japan .
2181742 4/1987 United Kingdom .

*Primary Examiner*—R. Dean
*Assistant Examiner*—Margery S. Phipps
*Attorney, Agent, or Firm*—Lieberman Rudolph & Nowak

[57] ABSTRACT

A cooper base alloy and process having high electrical conductivity. An alloy consists of from 0.005 to 0.15% by weight Niobium, about 0.005 to 0.15% by weight Iron, 0.01 to 0.05% by weight phosphorus, and the balance copper.

3 Claims, 1 Drawing Sheet

COOPER-FE-P-NB ALLOYS FOR ELECTRICAL AND ELECTRONIC PARTS AND ITS MANUFACTURING PROCESS

FIELD OF THE INVENTION

This invention relates to copper alloys for electrical and electronic parts and, more particularly, to a new and improved copper alloys with good conductivity, along with a manufacturing process for such new and improved copper alloys.

BACKGROUND OF THE INVENTION

Conventionally, copper is an important engineering metal since it is widely used in its unalloyed condition as well as in alloys with metals. In the unalloyed form, it has an extraordinary combination of properties which make it the basic material in the electrical industry, some of those properties being its high electrical and thermal conductivity and corrosion resistance. Because of its low strength of unalloyed copper, solute atoms introduced into solid solution in the solvent-atom lattice and invariably produces an alloy which is stronger than the pure metal. But the solute atoms have the maleficent effect of decreasing the electrical conductivity of pure copper with increasing the amount of the solute atoms. That is, the result of solute additions is to raise the strength and to decrease the eloectrical conductivity as a function of the amounts. Representative of copper alloys are C194 alloy and C195 alloy of Olin Company, USA, and PMC-102 alloy of Poongsan Corp., Korea, (C19010) (Korean Pat. Publication No. 84-1426, U.S. Pat. No. 4,466,939). Above alloys are well known as alloys exhibiting excellent mechanical properties, especially high tensile properties. Among the disadvantages of using these alloys are the low electrical conductivity (% IACS). Also, C194 and C195 were found to exhibit brittleness of corner crack when hot working since includes considerable amount of Fe, and difficulty in their cold-working process since high rolling ratio.

The uses of the lead-frame materials for surface mounting or power device depand mainly on the property of high electrical and thermal conductivity than high strength because of heat dissipation ability. The achievement of high strength without the much expense of electrical conductivity is obtained by precipitation hardening.

The precipitation hardening is produced by solution treating and quenching an alloy in which a second phase is in solid solution at the elevated temperature but precipitates upon quenching and aging at a lower temperature. In order to occur precipitation hardening, the second phase must be soluble at an elevated temperature but must exhibit decreasing solubility with decreasing temperature. Because of the finely dispersed second-phase particles, these alloys have high conductivity. Developed alloys geared to these needs are the alloy of Olin company, USA, (Cu-o0.5Cr-1.3Zr-0.05Fe, U.S. Pat. No. 4,224,006), KFC alloy of Kobe, Japan (Cu-0.1Fe-0.03P-X, where X is third element or mischmetal, Japanese Patent Publication No. SHO 58-53057), the alloy of Japan Mining Company (Cu-o0.13Fe-0.04P-0.32Zr, Japanese Patent Laid-Open No. SHO 62-214144) etc. But they have the disadvantages of high cost in alloying elements and not enough for conductivity (% IACS; below 85) and elongation. On the other hand, the alloy containing Nb is the alloy of Olin company, USA (Japanese Patent Laid-Open No. SHO 53-44422), but it also has the disadvantages of high cost in alloying elements and conductivity (% IACS) is in serious question.

It is therefore desirable to develop alloys which possess high conductivity and strength as well as low cost.

SUMMARY OF THE INVENTION

This invention relates to a copper bass alloy with high electrical conductivity.

The alloy consists of 0.005 to 0.15% by weight Niobium, 0.005 to 0.15% by weight Iron, 0.01 to 0.05% by weight Phophorus, and the balance copper. The alloy is melted in an induction furnace using 68Nb-Fe mother alloy and Cu-15P mother alloy and electrolyte Iron.

The molten metals were poured into a mould and after reheating the ingot at 750°~950° C., the ingot was hot-rolled. The hot-rolled plates were than subjected to several steps of cold rolling to the desired thickness. After, an annealing treatment (450°~500° C./ 1~3 hr) was conducted for recrystallization.

The high conductivity thereof is due to a precipitation by Nb, Fe and P addition and optimized heat-treatment.

The alloy hot-rolled, cold-rolled and annealed have an electrical conductivity of at least about 90% IACS.

DETAILED DESCRIPTION OF THE INVENTION

Figure 1:
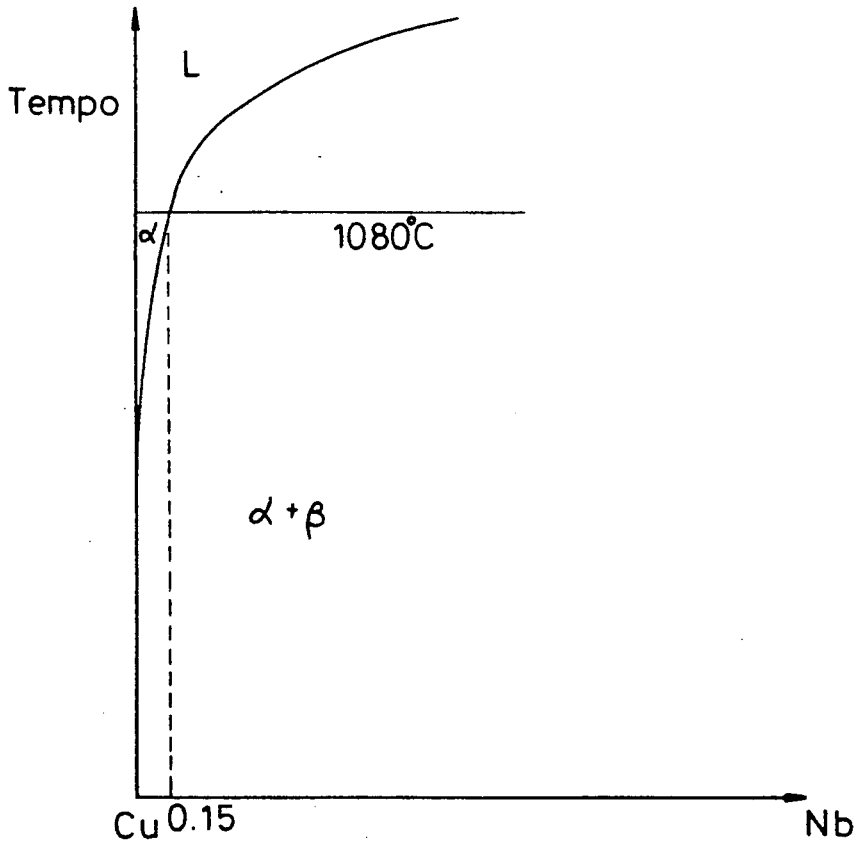
FIG. 1 is a phase diagram of Cu-Nb.

The invented alloy in the present description has a composition of Cu-0.005~0.15% Nb-0.005~0.15% Fe-0.01~0.05% P (wt %) where the microalloying elements (Nb, Fe and P) were added for precipitation hardening. The invented alloy exhibited high strength and good conductivity due to precipitation hardening.

Expensive alloying elements were eliminated or minimized. The invented high conductivity copper alloy consists of the balance Copper, 0.005 to 0.15% Niobium, 0.005 to 0.15% Iron, 0.01 to 0.05% Phosphorus by weight percent.

The manufacturing process is as follows. The Cu alloy consisting of the balance copper having 99% purity, 0.005 to 0.15% Nb, 0.005 to 0.15% Fe, 0.01 to 0.05% P was melted in an induction furnace under a reducing atmosphere using 68Nb-Fe and Cu-15P mother alloys. The molten metals were poured into a mould and after reheating the ingot at 750°~850° C., the ingot was hot-rolled to the desired thickness by a reversible hot-roller. The hot-rolled plates were then subjected to several steps of cold rolling to the desired thickness. After a cold-rolling, an annealing treatment (450°~500° C./1~3 hr) was conducted. High strength and good conductivity are due to a precipitation of Nb, Fe and P additions and optimized heat-treatment. In this invention, as shown in attached FIG. 1, Nb must be soluble at 1080° C., the melting temperature of Cu, to 0.01 at % (0.5 wt %), but must exhibit no solubility at room temperature and precipitates upon quenching and aging at low temperature.

The melting temperature of Nb is 2468° C. and the atomic weight is 92.71 and so is heavier than Cu(63.54). Therefore, in the case of using pure Nb metal, the melting process has difficulty because of the difference of melting point and it could make segregation because of the difference of the specific gravity. In order to settle these problems of the melting and segregation, a Fe-Nb mother alloy was used instead of pure Nb for decreasing melting point and specific gravity to that of Fe. The degree of reaction with oxygen of Nb could be decreased as using Fe-Nb mother alloy.

P addition in the form of a Cu-15P mother alloy was made for deoxidation during the melting process as acting a de-oxidizer. P amounts less than 0.05% resulted in a decrease in the amount of oxygen and increase the recovery ratio of Nb. Except for the deoxidizing part, P could make the effect of strengthening with Fe by forming the $Fe_3P$ precipitates when quenching to room temperature. Nb amounts more than 0.15 wt % resulted in excess of the solubility of copper.

EXAMPLE

The invented alloys (Alloy Nos. 1~5) composed of the compositions as shown in the table 1 were melted in an induction furnace using pure Cu, 68Nb-Fe and Cu-15P mother alloy, and electrolyte Iron and cast into a 50×50×130 mm mould.

TABLE 1

| | The Alloy Compositions | | | | | | |
|---|---|---|---|---|---|---|---|
| | No. of | chemical composition (wt %) | | | | | |
| | Alloy | Fe | Nb | P | Cr | Zr | Cu |
| The Present Invention | 1 | 0.07 | 0.04 | 0.03 | | | Balance |
| | 2 | 0.07 | 0.03 | 0.03 | | | " |
| | 3 | 0.05 | 0.07 | 0.03 | | | " |
| | 4 | 0.05 | 0.01 | 0.03 | | | " |
| | 5 | 0.07 | 0.02 | 0.03 | | | " |
| Olin Company, USA (U.S. Pat. No. 4224066) | 6 | | | | 0.5 | 0.13 | " |
| Olin Company, USA (Japanese Patent Pub. No. SHO 58-53057) | 7 | | 0.25 | | 0.55 | 0.15 | " |
| Kobe, Japan (Japanese Patent Pub. No. SHO 58-53057) | 8 | 0.1 | | 0.03 | 0.02 | | " |
| Japan Mining Co., Japan (Japanese Patent Laid-open No. SHO 62-214144) | 9 | 0.13 | | 0.04 | | 0.32 | " |
| Poogsan Corp., Korea PMC-102 | 10 | Ni 1.0 | Si 0.2 | 0.03 | | | Balance |

The cast ingots were homogenized 800° C. for 2-3 hours and hot-rolled at 780°~800° C. to a final thickness of 5 mm. The hot-rolled plates were then subjected to several steps of cold rolling to the final thickness of 2 mm. After a cold-rolling, an annealing treatment (450°~500° C. / 1~3 hr) was conducted. After annealing treatment, the physical property was measured and the results were shown in Table 2.

TABLE 2

| | | Physical Properties | | |
|---|---|---|---|---|
| | | Ultimate Tensile Strength ($Kg/cm^3$) | Elongation (%) | Electrical Conductivity (% IACS) |
| The present Invention | 1 | 28 | 40 | 90 |
| | 2 | 28 | 38 | 90 |
| | 3 | 28 | 40 | 90 |
| | 4 | 29 | 40 | 90 |
| | 5 | 28 | 40 | 90 |
| Prior Arts | 6 | 92 | 3.5 | 82.5 |
| | 7 | 83 | | 77 |
| | 8 | 33.6 | 33.5 | 80 |
| | 9 | 51 | 12 | 80 |
| | 10 | 51 | 8.2 | 70.8 |

From the above explanation, it is confirmed that the invented Cu alloy has excellent mechanical properties and good electrical conductivity. Also, the invented alloy exhibited high electrical conductivity superior to the CDA 194, CDA 195 and PMC-102.

The invented alloy containing microalloying elements Nb, Fe and P have the advantage of low cost in simple manufacturing process compared to the CDA 151 alloy. Therefore, the invented alloy could be used as power transistor and leadframe materials for surface mounting for example of TO-202 or TO-220.

Having described but a preferred embodiment of this invention, it will be apparent that many changes and modifications can be made therein without departing from the spirit of the invention as defined in the appended claims.

What is claimed is:

1. A copper alloy for electric and electronic parts having high conductivity characteristics, consisting of 0.005 to 0.15 by weight percent Niobium, 0.005 to 0.15 by weight percent Iron, 0.01 to 0.05 by weight percent Phophorus, and the balance copper.

2. An alloy as in claim 1 consisting of 0.01 to 0.07 by weight percent Niobium, 0.01 to 0.07 by weight percent Iron, 0.01 to 0.03 by weight percent Phophorus, and the balance copper.

3. A method of manufacturing a copper alloy for electric and electronic parts having high conductivity characteristics comprising:

(A) providing a Cu alloy ingot which consists essentially of 0.005 to 0.15 by weight percent Niobium, 0.005 to 0.15 by weight percent Iron, 0.01 to 0.5 by weight percent Phophorus and balance copper, by melting a 68Nb-Fe mother alloy, a Cu-15P mother alloy, and electrolyte Iron in an induction furnace;

(B) reheating the cast ingot at 750°-850° C., hot-rolling the ingot to desired thickness by a reversible hot-roller;

(C) then subjecting the hot-rolled ingot to several steps of cold rolling to a final thickness of 2 mm; and (D) after cold-rolling, annealing at 450°-500° C. for 1-3 hours.

* * * * *